US005896936A

United States Patent [19]

Häkkinen et al.

[11] Patent Number: 5,896,936

[45] Date of Patent: Apr. 27, 1999

[54] ARRANGEMENT FOR CONTROLLING BOOM FOR ROCK DRILLING UNIT

[75] Inventors: Leo Häkkinen; Jaakko Niemi; Pauli Lemmetty, all of Tampere, Finland

[73] Assignee: Tamrock Oy, Tampere, Finland

[21] Appl. No.: 08/776,945

[22] PCT Filed: Aug. 22, 1995

[86] PCT No.: PCT/FI95/00442

§ 371 Date: Feb. 14, 1997

§ 102(e) Date: Feb. 14, 1997

[87] PCT Pub. No.: WO96/07012

PCT Pub. Date: Mar. 7, 1996

[30] Foreign Application Priority Data

Aug. 30, 1994 [FI] Finland ..... 943979

[51] Int. Cl.[6] ..... E21B 15/04

[52] U.S. Cl. ..... 173/193; 173/4; 173/11

[58] Field of Search ..... 173/190, 192, 173/193, 194, 195, 42, 44, 4, 11, 13

[56] References Cited

U.S. PATENT DOCUMENTS

| | | | |
|---|---|---|---|
| 3,481,409 | 12/1969 | Westerlund . | |
| 3,724,559 | 4/1973 | Stromnes | 173/4 |
| 4,470,635 | 9/1984 | Paurat et al. | 173/4 |
| 4,484,637 | 11/1984 | Mayer | 173/190 |
| 4,535,972 | 8/1985 | Millheim et al. | 173/4 |
| 4,646,277 | 2/1987 | Bridges et al. | 173/4 |
| 4,799,556 | 1/1989 | Foster . | |
| 5,484,026 | 1/1996 | Susaki et al. | 173/4 |
| 5,713,422 | 2/1998 | Dhindsa | 173/4 |

*Primary Examiner*—Jessica J. Harrison
*Assistant Examiner*—John Paradiso
*Attorney, Agent, or Firm*—Nixon & Vanderhye P.C.

[57] ABSTRACT

An arrangement for limiting the swing angle of a boom for a rock drilling unit when the boom is being lifted and lowered. In the arrangement, a control member is coupled to the boom, turning therewith. The control member includes a slot which receives a movable dowel pin. The dowel pin is coupled to control a relief valve so that when the boom is being lifted or lowered, and when it tends to turn outside a predetermined widest permissible swing angle, the control member controls the relief valve so that it lets hydraulic fluid into the swing cylinder for turning the boom in a reverse direction.

7 Claims, 3 Drawing Sheets

ARRANGEMENT FOR CONTROLLING BOOM FOR ROCK DRILLING UNIT

BACKGROUND AND SUMMARY OF THE INVENTION

This invention relates to an arrangement for limiting the swing angle of a boom for a rock drilling unit when the boom is being vertically lifted and lowered, wherein the rock drilling unit comprises a boom, pivotally connected, relative to a frame, about vertical and horizontal shafts, and a swing cylinder and a tilt cylinder between the frame and the boom, in whose cylinder spaces hydraulic fluid may be fed for turning the boom relative to the frame.

A problem with booms for rock drilling units is that the swing angle of a boom changes when the angle of elevation of the boom changes, causing significant widening of the swing angle of the boom at its extreme height values and excessive lateral movement of the boom. Consequently, in known solutions, the swing angles of a boom are defined narrow enough for preventing excessive turning of the boom. This again results in the operating range of a boom being in some cases far too narrow as the whole available width area cannot be utilized in the mid-part of the boom because of problems with the upper and lower angles.

The object of the present invention is to provide an arrangement for eliminating the drawbacks of known solutions and allowing optimal utilization of the operating range of a boom. The arrangement of the invention is characterized in that it comprises control means for indicating the widest permissible swing angle of a boom, that the control means are coupled to control a swing cylinder so that if the boom, when being lifted or lowered, tends to turn outside the widest permissible swing angle, the control means let hydraulic fluid flow into the cylinder spaces of the swing cylinder for turning the boom to a reverse direction with respect to the turning movement caused by the lifting or lowering movements, thereby preventing the boom from exceeding the widest permissible swing angle.

It is an essential idea of the invention that the control means are coupled to the boom movably therewith and a relief valve is coupled to be controlled by the control means, whereat, with the boom turning to a predetermined swing angle, the control means control the relief valve so that it feeds hydraulic fluid into the swing cylinder of the boom and, correspondingly, discharges hydraulic fluid therefrom for maintaining the boom in this widest permissible position of the swing angle when it is lifted or lowered farther into the same direction, upward or downward, respectively.

It is an advantage of the invention that the widest possible operating range may be defined for a boom when it is essentially in the horizontal plane, whereat, with the arrangement of the invention, the same operating width is maintained for a boom both in its upper and lower positions without the joints or other parts of boom cylinders ending up in an unusual or operationally impossible position. This allows maximum boom coverage without problems of known solutions.

The invention will be described in greater detail in connection with the accompanying drawings.

FIGS. 1*a* and 1*b* are a schematic top and side view of a boom for a rock drilling unit, and the arrangement of the invention mounted on a boom structure, FIG. 2 schematically shows a hydraulic coupling of the arrangement of the invention and, FIGS. 3*a* and 3*b* schematically show some other applications of the arrangement of the invention.

DETAILED DESCRIPTION OF THE DRAWINGS

Figure 1A:
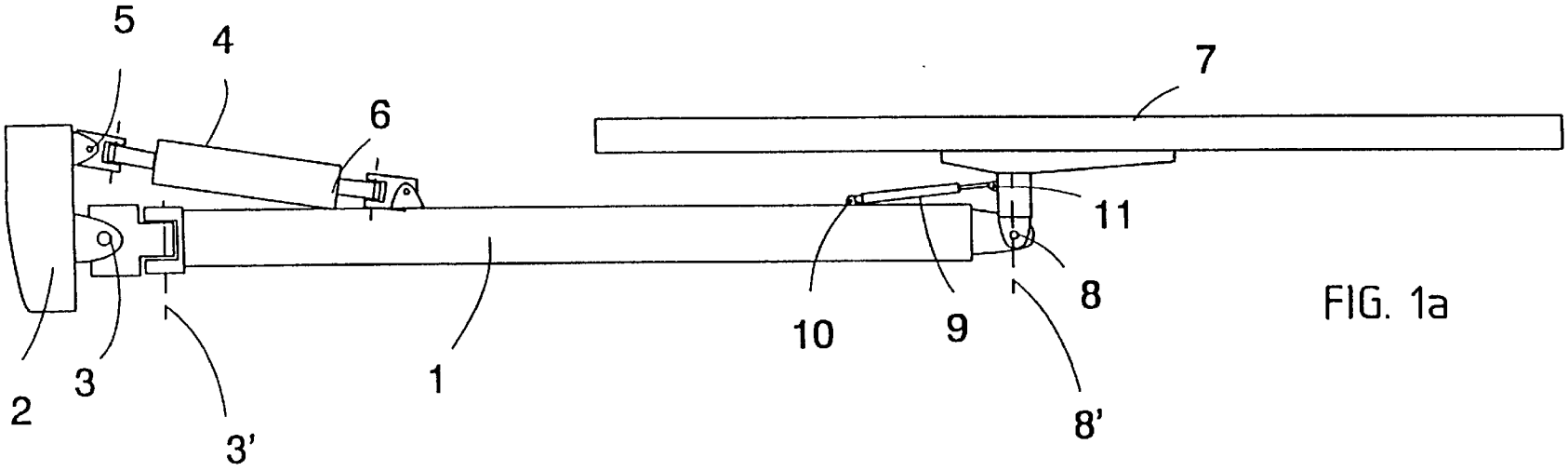
Figure 1B:
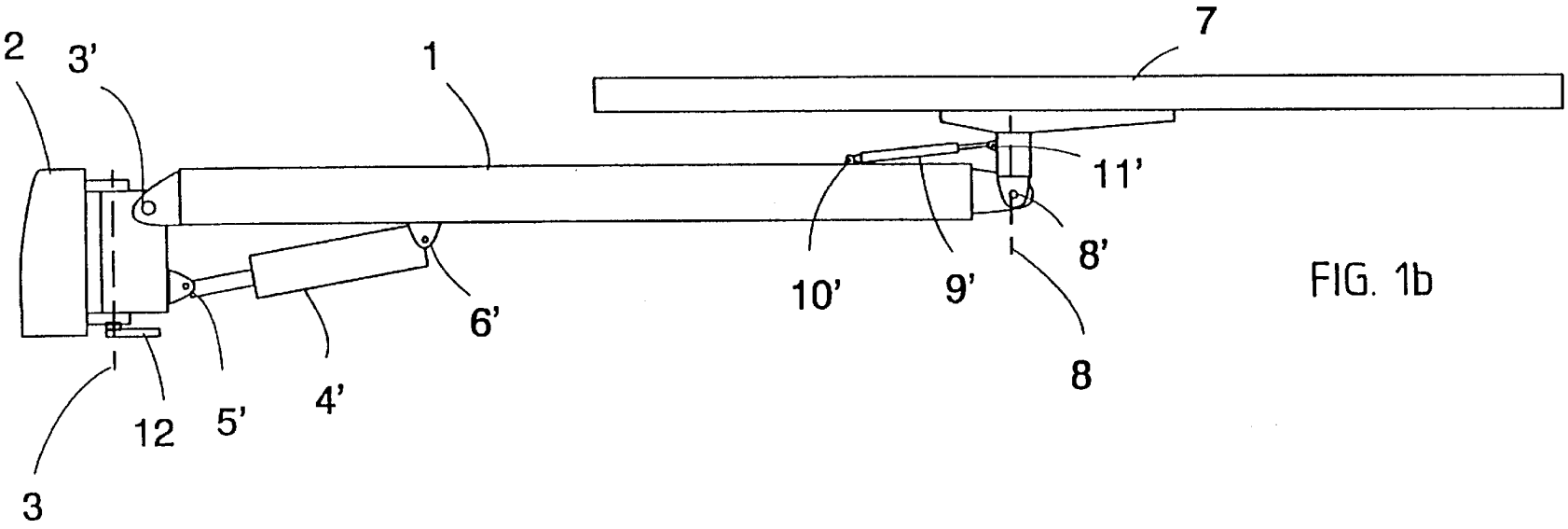

FIGS. 1*a* and 1*b* schematically show a boom 1 for a rock drilling unit, pivotally connected to a frame 2 about a vertical shaft 3. At the side of the boom 1 there is a swing cylinder 4, connected at its ends by joints 5 and 6 to the boom and, correspondingly, to the frame 2 for changing the direction of the boom relative to the frame 2 in a manner known per se. The other end of the boom comprises a feed beam 7, connected by a second vertical shaft 8 to the end of the boom for turning the feed beam relative to the end of the boom 1. A swing cylinder 9, between the feed beam 7 and the boom 1, is pivotally connected at its ends by joints 10 and 11. The swing cylinder 9 may be connected at its feed beam 7 end either direct to the feed beam, to a cradle of the feed beam, or in any other manner known per se to operate between the feed beam and the boom.

By means of the swing cylinder 9, the direction of the feed beam 7 relative to the boom 1 may be changed about the shaft 8 in a manner known per se. The boom 1 is pivotally connected about a horizontal shaft 3' relative to the frame 2 in a manner known per se, and a tilt cylinder 4' between the boom 1 and the frame 2 is connected at its ends by joints 5' and 6' to the boom and to the frame 2. At the other end of the boom 1, the feed beam 7 is pivotally coupled about a second horizontal shaft 8', and a tilt cylinder 9', between the feed beam 7 and the boom 1, is pivotally coupled at its ends by joints 10' and 11' for vertical turning of the feed beam 7 by means of the cylinder, relative to the boom 1, in a manner known per se. A control member 12 is coupled to turn with the boom 1 about the shaft 3 for controlling the lateral adjustment of the boom when the boom 1 is turned vertically FIG. 2 describes in greater detail the structure and operation of the control member 12.

Figure 2:
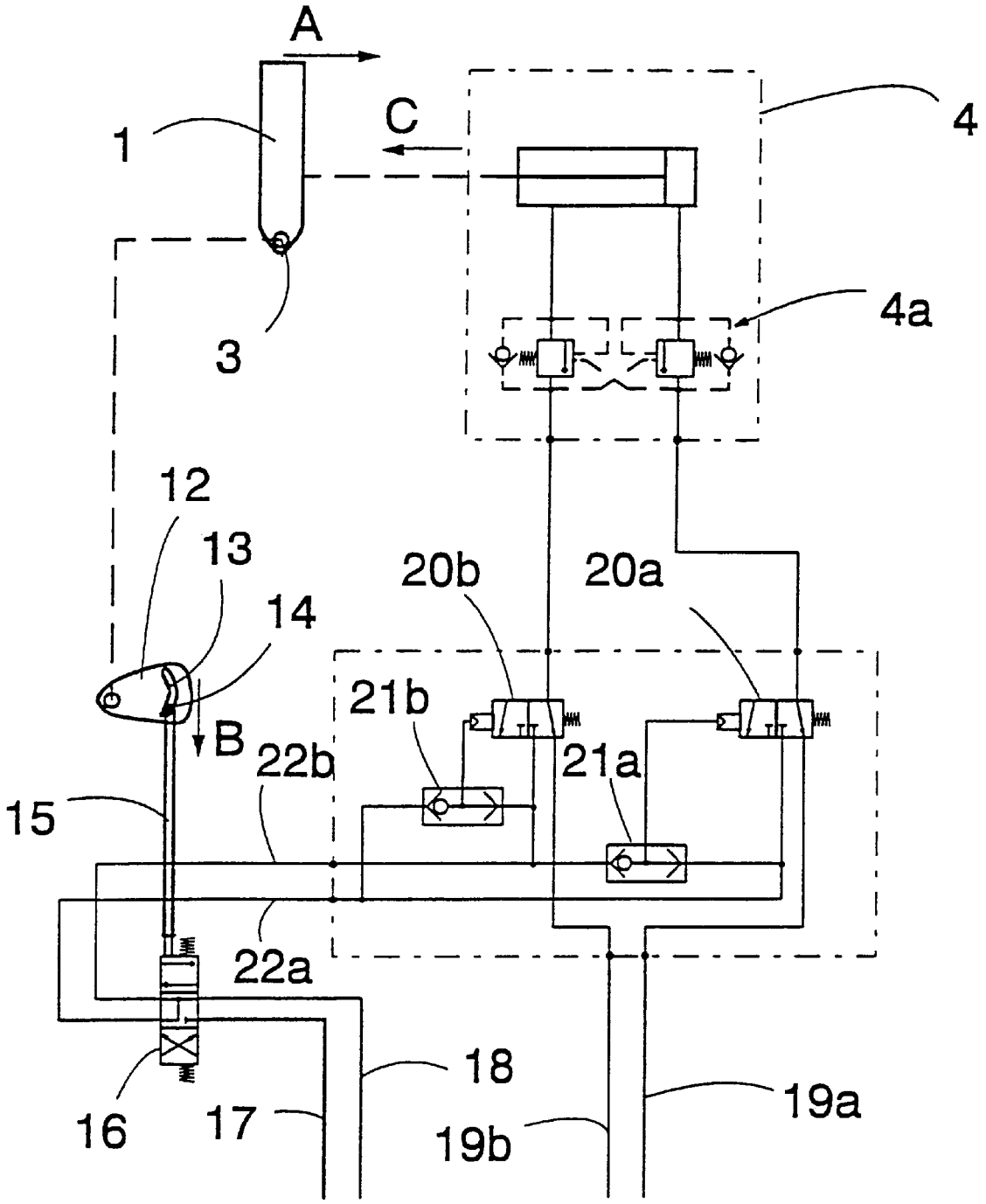

FIG. 2 schematically shows the control member 12, essentially of a circular sector shape, coupled to turn with the boom 1 about the shaft 3. The control member 12 comprises a slot 13 which receive a dowel pin 14 The dowel pin 14 is coupled e.g. by a shank 15 to a relief valve 16 utilized for controlling the lateral position of the boom if the boom tends to turn into a wider angle than the predetermined swing angle. The relief valve comprises a hydraulic fluid line 17 and an exhaust line 18 leading to a hydraulic fluid tank. The swing cylinder 4 of the boom comprises over-center valves 4*a*, which lock the swing cylinder hydraulically immovable unless hydraulic fluid is fed into it and, in case of overload, let the excess pressure out of the cylinder space. Hydraulic fluid is fed into the swing cylinder 4 via turning pressure lines 19*a* and 19*b*. The turning pressure lines 19*a* and 19*b* are separately connected via control valves 20*a* and 20*b* to the cylinder spaces of the swing cylinder 4. With the boom 1 in a normal position within permissible swing angles, the control valves 20*a* and 20*b* are in a position shown by the Figures. The control lines of the control valves are connected via shuttle valves 21*a* and 21*b* to control pressure lines 22*a* and 22*b*, respectively, emanating from the relief valve 16.

With the boom 1 within permissible swing limits, it may be turned in a desired manner by feeding hydraulic fluid into either of the turning pressure lines 19*a* and 19*b*, whereat, when hydraulic fluid flows via the control valve 20*a* or 20*b* to the second cylinder space of the swing cylinder 4, hydraulic fluid is correspondingly discharged from the other cylinder space via the second turning pressure line. If the boom 1 reaches its widest permissible swing angle, the dowel pin 14 comes into contact with the edge of the slot 13, and the relief valve 16 shifts so as to couple the hydraulic fluid channel and correspondingly the exhaust line to the control pressure lines 22*a* and 22*b* for preventing input of hydraulic fluid via the normal route to the swing cylinder 4, and the swing cylinder 4 stays at the widest permissible swing angle. When the boom 1 is at the widest permissible swing angle, it tends to turn outward as the geometric position formed by the cylinders changes when the boom is lifted or lowered, and the boom tends to turn laterally because of the lifting or lowering movements. In this situation, with the control member 12 turning with the boom 1, the dowel pin 14 comes into contact with the edge of the slot 13 thus causing the relief valve 16 to change its position. If the boom is e.g. lifted upward so that it tends to turn to the right as shown by arrow A in FIG. 2, the boom simultaneously pulls the control member 12 along to the direction of arrow B. This causes the relief valve 16 to move from the position shown in the Figure to a position where hydraulic fluid from line 17 is allowed to flow to the control pressure line 22*a* and correspondingly the control pressure line 22*b* is coupled to the exhaust line 18. This causes the hydraulic fluid in the line 22*a* to direct the control valves 20*a* and 20*b* from the position shown in the Figure to the right so that the control pressure line 22*a* is coupled via the control valve 20*a* to the right cylinder space of the swing cylinder 4 as shown in the Figure and to push the piston to the left as shown by arrow C in the Figure for compensating for the turning of the boom 1 to the direction of the arrow A. As long as the swing angle of the boom 1 causes the control member 12 to shift the relief valve 16, hydraulic fluid is fed to the swing cylinder 4. Correspondingly, hydraulic fluid from the second cylinder space of the swing cylinder 4 is allowed to flow via the control valve 20*b* to the control pressure line and further via the exhaust line 18 to a hydraulic fluid tank. Correspondingly, if the boom 1 turns to the opposite direction thus reaching its swing limit, the relief valve moves to the opposite direction and leads the hydraulic pressure of the hydraulic fluid line 17 via the control valve 20*b* to the swing cylinder 4 and the hydraulic fluid discharging therefrom correspondingly via the control valve 20*a* to the exhaust line 18.

Figure 3A:
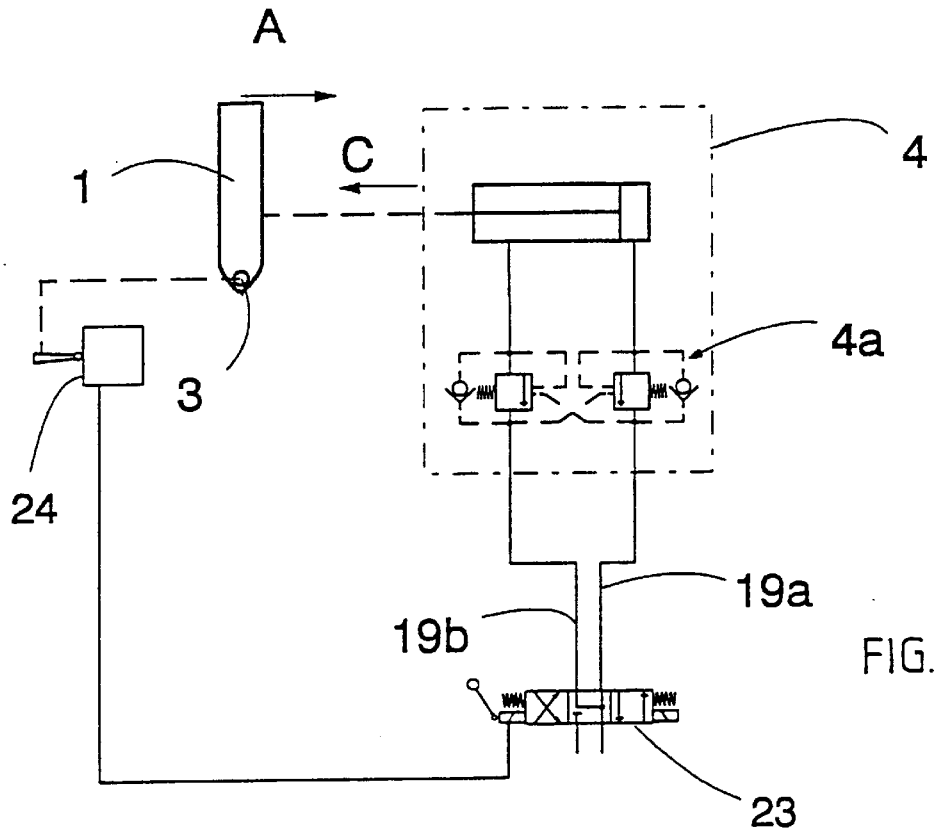
Figure 3B:
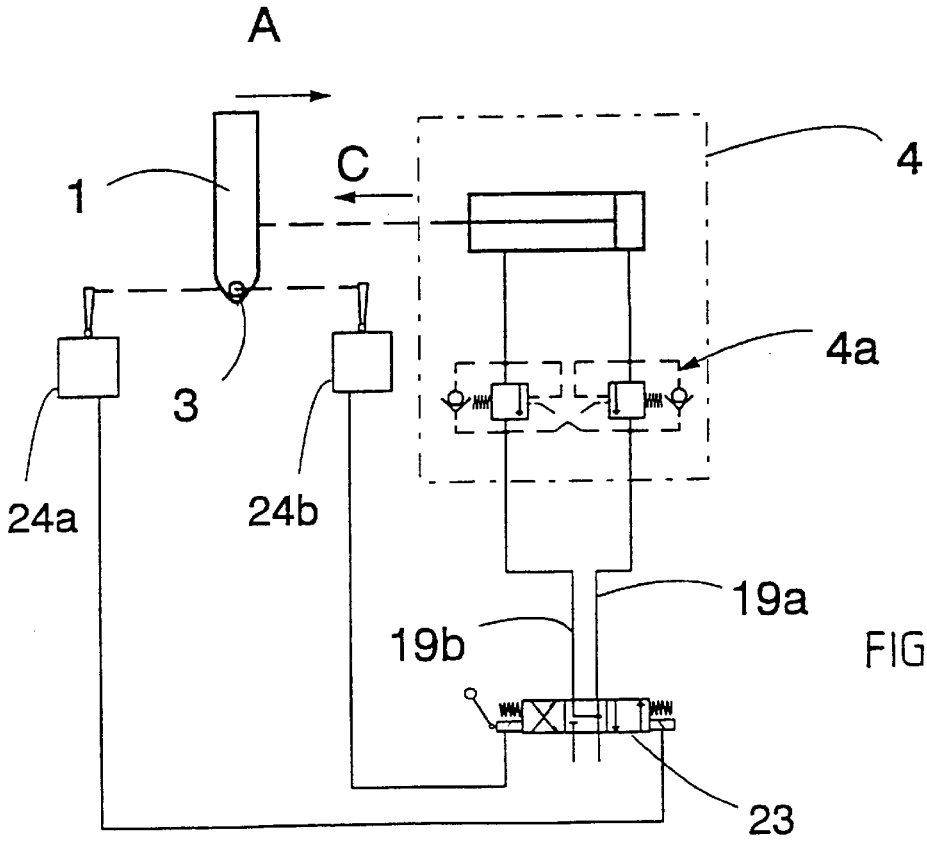

FIGS. 3*a* and 3*b* show an application where the invention is electrically controlled. In both Figures a boom swing valve 23 is connected to the turning pressure lines 19*a* and 19*b*, for controlling the turning of the boom either manually or, automatically in a manner known per se, by feeding hydraulic fluid to one of the lines 19*a* or 19*b* and correspondingly by allowing hydraulic fluid to flow from the other. In these applications an electrical limit sensor is utilized for indicating the swing angle of the boom 1, said sensor being a switch or similar electrical sensor indicating the specific permissible extreme angle of the boom. FIG. 3*a* shows a limit sensor 24, utilized for indicating the turning of the boom to either lateral direction when it reaches the permissible swing angle. The valve 23 is an electrically controlled valve, and when the limit sensor 24 indicates the extreme angle of the boom it starts to control the valve 23 so that it either stops the hydraulic fluid flow or, with status quo preserved, feeds hydraulic fluid to the swing cylinder for turning the boom 1 to the opposite direction. With the boom 1 turning to the reverse direction, the limit sensor 24 stops controlling the valve 23. FIG. 3*b* shows a solution where two electrical limit sensors 24*a* and 24*b* are utilized, both of which indicate their specific lateral direction. In case the boom turns to either direction reaching the widest permissible swing angle, the limit sensor on that side indicates the swing angle and directs the electrically controlled valve 23 to the reverse direction as long as the boom attempts to turn to a lateral direction. Functionally the solutions of FIGS. 3*a* and 3*b* are similar and the valve 23 is also functionally and structurally similar.

In the above description and in the drawings the invention has been described only by way of example, and it is by no means to be so restricted. The structure of the control member and its coupling to the boom 1 may be realized in several different manners; the member may be simply e.g. a peg or a slot controlling the relief valve in a desired manner. Other manners for the coupling may also be used. E.g. instead of a mechanical connection, an electrical connection may be utilized so that the swing positions of the boom, or each position separately, is indicated by an electrical sensor, which also controls the functioning of the relief valve 16. Similarly, different normal regulating valves and safety and security components may be added to the coupling without affecting the essential idea of the invention. For the same reason obvious components known per se have not been added to the Figures for clarity.

We claim:

1. An arrangement for limiting the swing angle of a boom for a rock drilling unit when the boom is being vertically lifted and lowered, wherein the rock drilling unit comprises a boom connected to a frame for pivotal movement relative to the frame about vertical and horizontal shafts; a swing cylinder connected between the frame and the boom for moving the boom about the vertical shaft, and a tilt cylinder also connected between the frame and the boom for moving the boom about the horizontal shaft, wherein hydraulic fluid may be fed to said swing cylinder and said tilt cylinder for turning the boom relative to the frame; and control means for indicating a predetermined widest permissible swing angle of the boom about said vertical shaft, said control means being coupled to control the swing cylinder so that if the boom tends to turn outside the predetermined widest permissible swing angle as result of the boom being lifted or lowered, the control means causes hydraulic fluid to flow into said swing cylinder to thereby turn the boom in a reverse direction with respect to turning movement caused by the lifting or lowering movements of the boom thereby preventing the boom from exceeding the predetermined widest permissible swing angle.

2. An arrangement as claimed in claim 1, and including a relief valve with a hydraulic fluid line and an exhaust line connected thereto, said relief valve being coupled so as to be controlled by the control means, and wherein the relief valve is coupled by separate first and second control pressure lines to respective first and second control valves located in turning pressure lines leading to the swing cylinder, such that when the relief valve connects the hydraulic fluid line and the exhaust line to the first and second control pressure lines, hydraulic fluid from the hydraulic fluid line starts to flow via one of the first and second control valves to the swing cylinder so that movement of a piston in the swing cylinder moves the boom in an opposite direction to its turning direction.

3. The arrangement as claimed in claim 2, wherein two shuttle valves are located between the first and second control pressure lines and wherein the first control pressure line is coupled to the first control valve and the second control pressure line is coupled to the second control valve, and wherein an outlet line of both control valves is coupled to a control pressure line of one of the control valves.

4. The arrangement as claimed in claim 1, wherein the control means comprises a control member turning with the boom, said control member having a curved slot which receives a movable dowel pin coupled to control the relief valve.

5. The arrangement as claimed in claim 1 wherein the control means comprises at least one electrical sensor, coupled to identify the predetermined widest permissible swing angle of the boom and to control the turning of the boom.

6. The arrangement as claimed in claim 4, wherein said control means comprises two separate electrical sensors, coupled to identify the predetermined widest permissible swing angles of the boom in opposite directions and to correspondingly control the turning of the boom.

7. The arrangement as claimed in claim 6, wherein the electrical sensors are coupled to control the relief valve on the basis of the identified predetermined widest swing angle.

* * * * *